US005117741A

United States Patent [19]

Richards

[11] Patent Number: 5,117,741

[45] Date of Patent: Jun. 2, 1992

[54] DOUBLE WALL HYDRAULIC CYLINDER

[75] Inventor: Paul D. Richards, Nokomis, Fla.

[73] Assignee: Sta-Rite Industries, Inc., Milwaukee, Wis.

[21] Appl. No.: 465,909

[22] Filed: Jan. 16, 1990

[51] Int. Cl.[5] ..... F01B 15/04

[52] U.S. Cl. ..... 92/119; 92/128; 114/286

[58] Field of Search ..... 92/66, 109, 110, 111, 92/112, 117 R, 118, 119, 128, 163, 164, 169.1, 169.2, 169.4, 171.1; 114/284, 285, 286

[56] References Cited

U.S. PATENT DOCUMENTS

| | | | |
|---|---|---|---|
| 165,027 | 6/1875 | Riley . | |
| 371,919 | 10/1887 | Belden . | |
| 1,872,666 | 8/1932 | Brownell . | |
| 2,293,585 | 8/1942 | Bard | 285/97.3 |
| 2,487,920 | 11/1949 | Celenza | 92/169.1 |
| 2,710,598 | 6/1955 | Baas | 121/46 |
| 2,761,425 | 9/1956 | Bertsch et al. | 92/163 |
| 2,768,842 | 10/1956 | McDermott | 285/136 |
| 2,781,055 | 2/1957 | Jackson | 137/580 |
| 2,790,426 | 4/1957 | Mueller | 92/119 |
| 2,823,074 | 2/1958 | Bernard, Jr. | 299/78 |
| 3,093,117 | 6/1963 | Brown | 92/163 |
| 3,153,988 | 10/1964 | Warstler | 92/119 |
| 3,202,062 | 8/1965 | Burden | 92/119 |
| 3,399,786 | 9/1968 | Honeycutt | 212/58 |
| 3,628,487 | 12/1971 | Bennett | 114/66.5 |
| 3,678,810 | 7/1972 | Holmes et al. | 92/119 |
| 3,873,133 | 3/1975 | Berg et al. | 285/136 |
| 3,962,956 | 6/1976 | Jacobellis | 92/112 |
| 3,981,329 | 9/1976 | Wohlwend | 137/615 |
| 4,194,767 | 3/1980 | McCracken | 285/134 |
| 4,276,971 | 7/1981 | Horvath | 92/128 |
| 4,362,324 | 12/1982 | Kelly | 285/119 |
| 4,414,881 | 11/1983 | Devaud | 92/128 |
| 4,530,422 | 7/1985 | Bogenschutz | 188/52 |
| 4,570,978 | 2/1986 | Arendt | 285/131 |
| 4,679,829 | 7/1987 | Yanagisawa | 285/190 |
| 4,775,174 | 10/1988 | Dalla Bona et al. | 285/190 |
| 4,791,854 | 12/1988 | Bancevic | 92/5 R |
| 4,796,927 | 1/1989 | Bona et al. | 285/190 |
| 4,802,404 | 2/1989 | Dirkin et al. | 92/171.1 |
| 4,854,259 | 8/1989 | Cluett | 114/285 |

FOREIGN PATENT DOCUMENTS

| | | | |
|---|---|---|---|
| 693083 | 8/1964 | Canada . | |
| 247316 | of 1912 | Fed. Rep. of Germany | 92/119 |
| 47774 | 7/1937 | France | 92/163 |
| 1280935 | of 1962 | France | 92/163 |
| 599136 | 3/1978 | U.S.S.R. . | |
| 694723 | 10/1979 | U.S.S.R. . | |
| 226589 | 12/1924 | United Kingdom . | |
| 759098 | 10/1956 | United Kingdom . | |
| 2033536 | 5/1980 | United Kingdom | 92/171.1 |

*Primary Examiner*—Edward K. Look
*Assistant Examiner*—Thomas Denion
*Attorney, Agent, or Firm*—Peter N. Jansson, Ltd.

[57] ABSTRACT

An improved double wall cylinder includes a neck which extends along an axis generally coincident with the longitudinal axis of the cylinder. This neck supports an outer wall and an inner wall and includes a first passage and a second passage for providing fluid communication between the cylinder and a remote control unit. The outer and inner tubular walls are preferably formed of commonly available tubing and the manufactured cost of the cylinder may be reduced by the fact that one of the tubular walls is devoid of threads, apertures and other machined portions. If the end gland is removed for service, the inner wall is frictionally retained in position while the piston assembly is withdrawn. The inner wall may then be removed, leaving the outer wall attached to the neck by a threaded connection. Risk of accidential loss of parts is thereby reduced. The cylinder is configured for use with a mounting plate of the type having a pair of spaced, outwardly extending hollow lugs. The cylinder includes a unique neck which allows the cylinder to be installed to or removed from the lugs for service without disturbing the position of the mounting plate or the lugs.

6 Claims, 5 Drawing Sheets

DOUBLE WALL HYDRAULIC CYLINDER

FIELD OF THE INVENTION

This invention is related generally to hydraulic cylinders and, more particularly, to an improved double wall hydraulic cylinder which is easily serviced in the field and may have manufacturing cost advantages. The improved cylinder is particularly useful for adjusting the position of a trim tab on a boat.

BACKGROUND OF THE INVENTION

Power boats, especially of the inboard type, are often equipped with trim tabs which extend from the rear of the hull and are pivotably attached at a point near the bottom surface of the boat. These tabs are adjustable to permit trimming the craft in view of varying load distributions, speeds, water and wind conditions and the like. Usually a hydraulic cylinder is used for tab positioning and is mounted with one end attached to the boat transom and the other, the rod end, to the trim tab for positioning. Rod extension and retraction is by a hydraulic control unit mounted within the boat and controlled by the operator Examples of such trim tab and cylinder installations are shown and described in U.S. Pat. Nos. 3,628,487 and 4,854,259.

Several design parameters affect the configuration of such hydraulic cylinders. One is that the cylinder must be adapted for easy, quick repair since downtime represents at least an annoyance to the boat operator. If the boat is used for charter or other commercial service, such downtime can have a serious impact on profitability. If the cylinder is configured so that parts are easily lost during disassembly, downtime may be lengthened appreciably. In addition, a cylinder for adjusting trim tab position must be capable of being mounted for pivoting movement since such movement is required as the position of the tab is changed.

The ideal hydraulic cylinder for trim tab adjustment would not only have design features which would permit it to be manufactured for a lower cost but would also be configured to permit very easy repair while yet minimizing the risk of loss of parts. The ideal cylinder would also be readily adapted to be mounted for pivoting movement.

One example of a hydraulic cylinder which is arranged for pivot mounting is shown in U.S. Pat. No. 2,790,426. The cylinder shown therein can neither be installed nor removed from its mounting base without disturbing at least one support block. In addition, both the outer and inner cylinder walls include portions which are machined and which are therefore more expensive to manufacture. And when the cylinder gland is removed, the outer wall (which is a part least likely to require service) immediately becomes separated from the trunnion. If service is being performed over water, this wall could be readily and irretrievably lost.

Examples of hydraulic swivel joints are shown and described in U.S. Pat. Nos. 3,981,329 and 2,768,842. Neither of the swivel joints described in those patents permit removal of the center journal block without dismantling and removing part of the joint components.

A double wall hydraulic cylinder which is designed to minimize the amount of machining required in its manufacture and which is readily serviceable or removable from a boat transom without disturbing the mounting lugs or hydraulic conductors while yet minimizing the risk of loss of parts would be a distinct advance in the art.

OBJECTS OF THE INVENTION

It is an object of this invention to overcome some of the problems and shortcomings of the prior art.

Another object of the invention is to provide a hydraulic cylinder wherein one of the walls is devoid of threads, apertures and other machined areas.

Another object of the invention is to provide an improved hydraulic cylinder wherein the internal components may be removed for servicing without disturbing the outer wall.

Still another object of the invention is to provide a hydraulic cylinder which is removable from the transom of a boat without disturbing the cylinder mounting lugs.

Yet another object of the invention is to provide an improved hydraulic cylinder which can be removed for service without disturbing the hydraulic lines which direct fluid to and from the cylinder.

These and other important objects will be apparent from the descriptions of this invention which follow.

SUMMARY OF THE INVENTION

The improved double wall cylinder includes a neck which extends along an axis generally coincident with the longitudinal axis of the cylinder. This neck supports an outer wall and an inner wall and includes a first passage and a second passage. These passages are oriented to be generally parallel to the axis and provide fluid communication between the cylinder and an external control unit.

In one embodiment, the outer tubular wall has interior threads at its proximal end and at its distal end with the proximal end being threadably engaged with the neck. The inner tubular wall is mounted in fitted engagement with the neck and in a position so that the inner wall and the outer wall define an annular space between them. In a second embodiment, the interior tubular wall is threaded at both ends and the outer wall is mounted in fitted engagement with the neck to define an annular space between the walls.

In one embodiment, a gland is attached in fitted engagement with the inner wall and has exterior threads which engage with the interior threads at the distal end of the outer wall. A movable piston assembly is disposed in the inner wall and includes a head which is slidably engaged with the inner wall and an elongate rod which protrudes through the gland to the exterior of the cylinder. The rod, the inner wall, the head and the gland generally define a first expansible chamber which is in fluid communication with the first passage in the neck. The inner wall, the neck and the head generally define a second expansible chamber which is in fluid communication with the second passage. In another embodiment, the inner wall is threadably attached to the neck and to the gland.

Manufactured cost will likely be reduced by the fact that the outer wall and the inner wall are formed of commonly-available tubular stock and that one of the walls is constructed to be devoid of threads, apertures and other machined areas.

The improved cylinder is preferably constructed to be used with a transom mounting plate of the type having a pair of spaced, outwardly extending lugs and suitable ports and passages for providing fluid communication between the cylinder and the remote hydraulic control unit Accordingly, in a highly preferred embodiment, the neck has a pair of laterally extending arms which provide fluid communication between the hydraulic control unit and the cylinder. Each arm terminates in an annular surface and these surfaces are spaced to fit between and contact with corresponding annular faces on a pair of lugs which extend outward from the transom mounting plate. Hollow bushings extend between and are in sealing engagement with each arm and its associated lug and provide fluid communication between the mounting plate and the cylinder. Each bushing is retained in position by a threaded retainer plug.

The bushings may be readily withdrawn, thus permitting the cylinder neck to be slidably removed from and inserted into the space between the faces of the lugs. The entire cylinder may thereby be quickly removed and installed during field service without disturbing the position of the lugs.

DETAILED DESCRIPTIONS OF PREFERRED EMBODIMENTS

Figure 1:
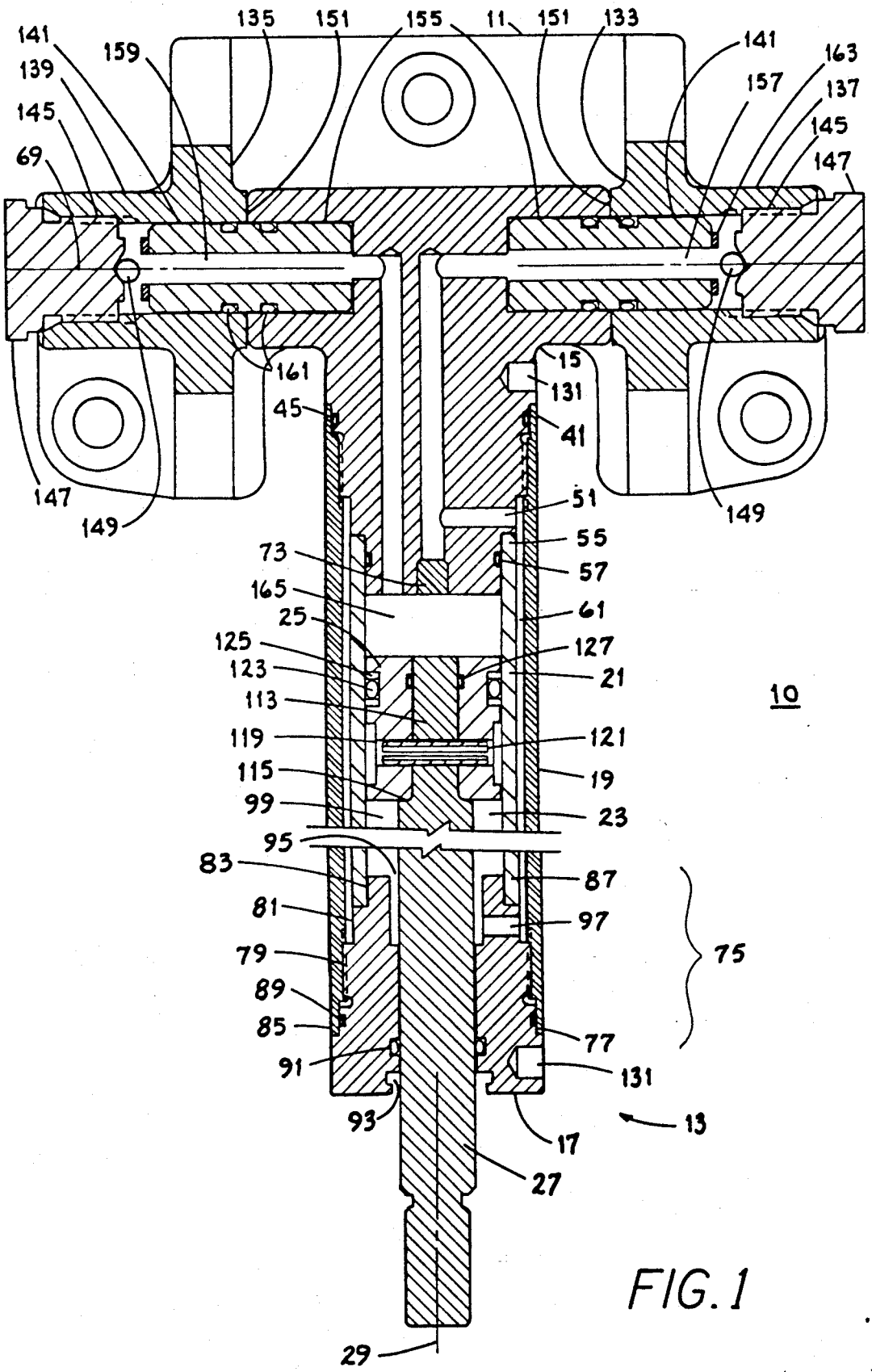
FIG. 1 is a cross-sectional view of one embodiment of the improved cylinder shown in conjunction with a mounting plate which is shown partly in cross-section and which is for attaching the cylinder to the transom of a boat. The cross-sectional view is taken in a plane which is coincident with the longitudinal axis of the cylinder and with the pivot axis of the neck.

Referring the FIG. 1, the improved double wall hydraulic cylinder 10 is shown to be oriented as mounted on a boat, i.e., with a mounting plate 11 at the top and the rod end 13 at the bottom. The cylinder 10 has as its primary constituents a neck 15, a gland 17 and an outer wall 19 and an inner wall 21, both of which are supported by the neck 15 and the gland 17. A piston assembly 23 is slidably received in the inner wall 21 for reciprocating movement. This assembly 23 has a piston head 25 and an elongate rod 27 attached to the head 25 and extending through the gland 17 to the exterior of the cylinder 10.

Figure 2:
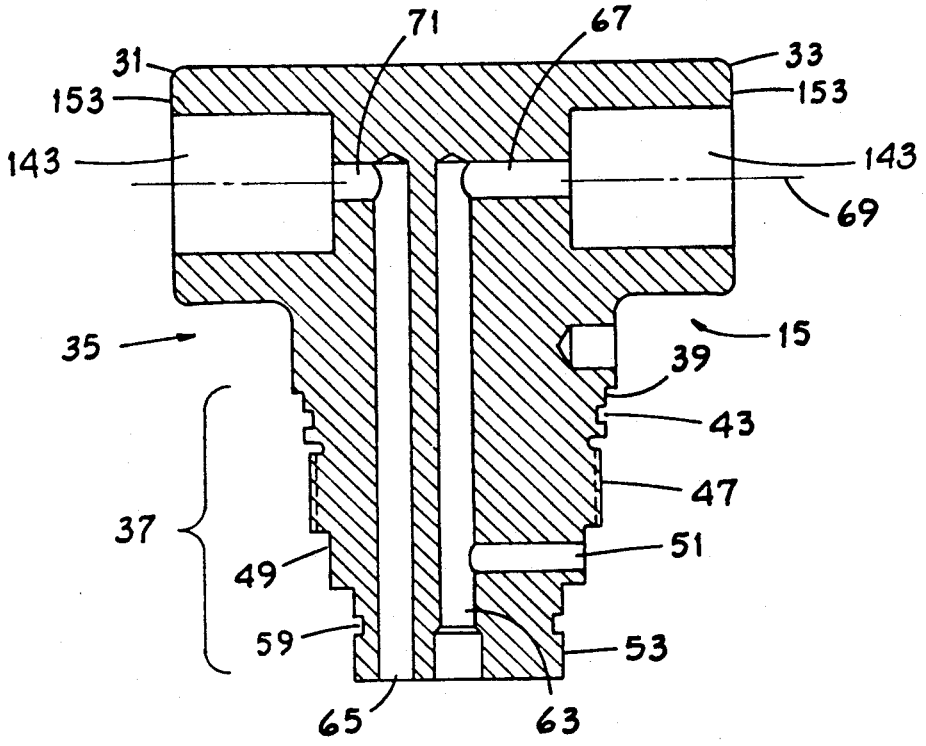
FIG. 2 is a cross-sectional view, somewhat enlarged, of the neck portion of the cylinder shown in FIG. 1, viewed in the same plane.

Referring additionally to FIG. 2, the neck 15 extends downward (as viewed in FIGS. 1 and 2) in a direction and along an axis 29 generally coincident with the longitudinal axis of the cylinder 10. The neck 15 has a left arm 31 and a right arm 33, both laterally extended, and a body 35 having regions 37 of progressively decreasing diameter when viewed from top to bottom in FIG. 2. The first of these regions 37 is a sealing perimeter 39 which has a length and diameter selected to engage and closely fit with the extreme proximal end 41 of the outer wall 19. The sealing perimeter 39 includes an O-ring groove 43 circumferentially formed to a depth therein. An O-ring 45 placed in this groove seals against the outer wall 19.

The next region 37 is the attachment collar 47 which has a diameter somewhat less than that of the sealing perimeter 39 and which is threaded to engage with the threads formed on the interior of the outer wall 19 near its proximal end 41.

A relief shoulder 49 is located adjacent the attachment collar 47 and has a diameter diminished somewhat from that of the collar 47 and a width sufficient to accommodate a transverse passage 51 as described below. The neck 15 terminates in a nose 53 which is formed adjacent the relief shoulder 49 and which has a diameter selected such that the nose 53 may be snugly fitted into the proximal end 55 of the inner wall 21. Hydraulic fluid is prevented from leaking between the inner wall 21 and the nose 53 by an O-ring 57 which is disposed in a circumferential groove 59 formed in the nose 53.

The inner wall 21 abuts the relief shoulder 49 and, in FIG. 1, it is to be observed that the relative diameters of the attachment collar 47, relief shoulder 49 and nose 53 and the relative thicknesses of the outer wall 19 and the inner wall 21 cooperate to define an annular space 61 between the inner wall 19 and the outer wall 19.

The neck 15 also includes a first passage 63 and a second passage 65 which, respectively, are oriented to be generally coincident with and parallel to the axis 29 and which help provide fluid communication between the cylinder 10 and the external hydraulic control unit (not shown). The first passage 63 connects to a passage 67 formed in the arm 33, the passage 67 having its longitudinal axis generally coincident with the pivot axis 69. Similarly, the second passage 65 connects to a passage 71 which is formed in the arm 31 and which likewise has its longitudinal axis generally coincident with the pivot axis 69. At one end, the first passage 63 is closed by a plug 73 and connects at its mid-length to a radial transverse passage 51 which intersects with the first passage 63 and with the relief shoulder 49. This passage 51 provides fluid communication between the annular space 61 and the passage 63.

Referring again to FIG. 1, a gland 17 closes the rod end 13 of the cylinder 10 and supports the outer wall 19, the inner wall 21 and the rod 27 which extends through the gland 17. The gland 17 also includes several regions 75 which are formed in progressively diminishing diameters when viewed from bottom to top. These regions 75 include a sealing perimeter 77, an attachment collar 79, a relief shoulder 81 and a nose 83. The structure and function of the perimeter 77, the collar 79, the relief shoulder 81 and the nose 83 are closely similar to their counterparts of the same name which are formed on the neck 15. That is, the sealing perimeter 77 seals against the interior surface at the extreme distal end 85 of the outer wall 19 and the attachment collar 79 has exterior threads which engage with interior threads formed on the outer wall 19. The diameter of the nose 83 is selected to snugly fit within the distal end 87 of the inner wall 21 and appropriate dimensional selection of the foregoing regions 75 maintains the annular space. O-ring seals 89, 91 are lodged in circumferential grooves formed in the sealing perimeter 77 and in the interior of the gland 17, respectively, to prevent fluid leakage to the exterior of the cylinder 10. A cavity 93 is formed in the exterior end of the gland 17 to be concentric with the longitudinal axis 29 of the cylinder 10 and receives a wiper seal (not shown).

At its interior end, the gland 17 includes a concentric relief pocket 95 which is formed to a depth and which has a diameter slightly in excess of that of the rod 27. A transverse passage 97 communicates between the annular space 61 and the relief pocket 95 and thence to the first expansible chamber 99.

Figure 3:
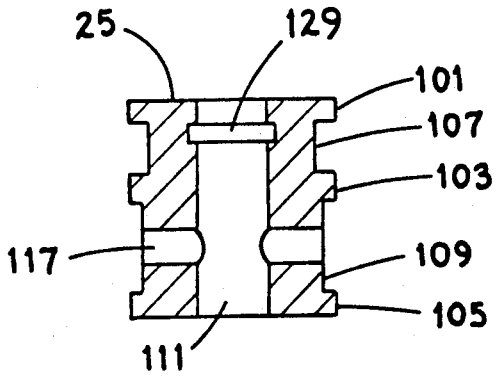
FIG. 3 is a cross-sectional view of the head of the piston assembly, slightly enlarged, the view being in the same plane as that of FIGS. 1 and 2.

A piston assembly 23 is received within the inner wall 21 for sliding reciprocating movement and includes a head 25 and an elongate rod 27 attached to the head 25. Referring additionally to FIG. 3, the head 25 includes a first land 101, a second land 103 and a third land 105. The first land 101 and the second land 103 define a first groove 107 while the second land 103 and the third land 105 define a second groove 109. The head 25 has a longitudinal hole 111 concentrically formed therein to receive the proximal end 113 of the rod 27. The diameter of this end 113 is reduced to closely fit within the hole 111 and the resulting shoulder 115 helps retain the relative position of the head 25 and the rod 27. A transverse hole 117 is formed in the second groove 109 and is located to be registry with a transverse hole 119 formed in the rod 27 when the rod 27 and the head 25 are assembled. The head 25 and the rod 27 are maintained in a connected relationship by a roll pin 121 which extends through the holes 117, 119.

A resilient seal 123 and a pair of relatively rigid backup seals 125 are received within the first groove 107 for providing sealing engagement of the head 25 with the interior surface of the inner wall 21. An O-ring 127 received in a groove 129 formed in the interior of the head 25 prevents leakage of hydraulic fluid between the head 25 and the rod 27.

Tool insertion pockets 131 are formed in the gland 17 and in the neck 15 to permit torque to be applied during assembly or disassembly of the cylinder 10.

From the foregoing, several observations can be made. First, the gland 17 can be removed from the cylinder 10 and the inner wall 21 and the piston assembly 23 can be withdrawn for servicing without removing or otherwise disturbing the position of the outer wall 19. This has several very favorable implications. Because of the sliding movement of the piston head 25 within the inner wall 21 and of the rod 27 within the gland 17, the inner wall 21, gland 17 and piston assembly 23 are the parts which tend to require more frequent service. The outer wall 19, having no moving parts associated with it, usually requires little if any service. The configuration of the inventive cylinder 10 permits retention of the outer wall 19 securely in position while internal parts are being repaired.

It is sometimes necessary to perform cylinder service over water and the design of the improved cylinder 10 permits one to deliberately and sequentially remove its parts without significant risk of dropping one or more of them. For example, the set of parts comprising the gland 17 and the piston assembly 23 may be removed first and in sequence with little concern that the inner wall 21, being fitted snugly to the nose 53, will fall from location. Next, the inner wall 21 may be slidably removed from the nose 53 while yet leaving the outer wall 19 attached to the neck 15 by a threaded connection.

Figure 4:
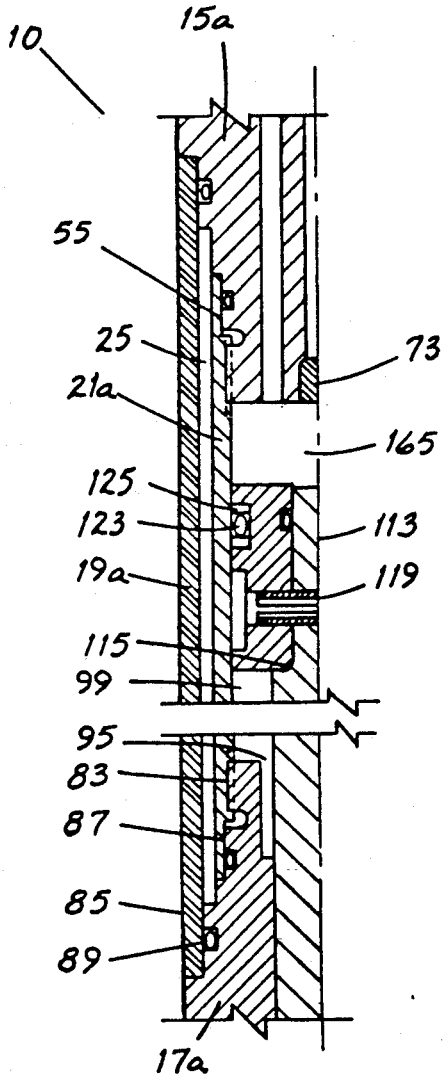
FIG. 4 is a view, partly in cross section with parts broken away, showing another embodiment of the cylinder walls shown in FIG. 1.

FIG. 4 shows another embodiment of the cylinder 10 which differs from that shown in FIG. 1 by the fact that the inner wall **21*a* is formed to have interior threads at its proximal end 55 and at its distal end 87 with the proximal end 55 being threadably engaged with the neck 15*a*. Similarly, its distal end 87 has interior threads to engage with the gland 17*a*. O-ring seals prevent fluid from leaking between the wall 21*a* and the neck 15*a* and between the wall 21*a* and the gland 17*a***.

In this embodiment, the outer wall **19*a* is constructed to be devoid of threads, apertures and other machined areas. The distal end 85 of the outer wall 19*a* is snugly fitted to the neck 15*a* while the proximal end 41 of the outer wall is snugly fitted to the gland 17*a***. O-ring seals prevent fluid leakage.

The configuration of the FIG. 4 is something of an "inside out" version of the cylinder of FIG. 1. That is, in the embodiment of FIG. 4, the inner wall **21*a* is threadably attached to the neck 15*a* and the gland 17*a* while the outer wall is slidably, snugly fitted to the neck 15*a* and the gland 17*a* rather than being threadably attached thereto. In either embodiment, the sliding, snug fit of a wall 19, 19*a*, 21, 21*a* to the neck 15, 15*a* is preferably selected so that the wall 19, 19*a*, 21, 21*a*** is positionally retained during disassembly for service but can nevertheless be rather easily removed.

From the foregoing, it will be noted that the walls 19, **19*a* and 21, 21*a* can be formed of tubing. Since the cylinder 10 is fabricated to have one of the walls 19, 19*a* or 21, 21*a* devoid of threads and apertures, the cost of manufacturing the cylinder may thereby be reduced. In any event, it is highly likely that the cost of manufacturing the improved cylinder 10** will be more favorable than the cost of manufacturing the cylinder shown in U.S. Pat. No. 2,790,426.

Referring again to FIGS. 1 and 2, in a highly preferred embodiment, the cylinder 10 is arranged for attachment to a mounting plate 11 of the type having a pair of spaced hollow lugs 133, 135 which extend outward, i.e., in the direction of the viewer as shown in FIG. 1. Each lug 133, 135 includes a hollow, laterally extending sleeve 137, 139 respectively, the interior cavity 141 of which has a diameter substantially identical to that of the pocket 143 formed in the adjacent arm 33, 31 respectively, and substantially concentric therewith. The outward end of each sleeve 137, 139 has interior threads 145 for receiving a retaining plug 147. The interior cavity 141 of each sleeve 137, 139 communicates with a hole 149 through the mounting plate and thence to hydraulic hoses (not shown). These hoses may be connected to that side of the plate 11 facing the interior of the boat and to the hydraulic control unit. In the alternative, these hoses may be connected to a manifold block (not shown) which is mounted to interface with the rear surface of the mounting plate 11. Such an arrangement is described in further detail with respect to FIGS. 7A–7C below.

Each lug 133, 135 has an inwardly directed, generally planar, annular face 151. In a highly preferred embodiment, these faces 151 are parallel to a plane which is normal to the pivot axis 69 and which includes the longitudinal axis 29. When the cylinder 10 and its neck 15 are in position, each face 151 is in contact with the associated surface 153 of an arm 31, 33. In the absence of the bushings 155, the neck 15 can therefore be slidably inserted into and removed from the space between the faces 151 of the lugs 133, 135 without disturbing the mounting plate 11 or the position of the lugs 133, 135.

Each cylindrical bushing 155 has a longitudinal passage 157 and 159 respectively, therethrough. The passage 157 is in fluid communication with the passage 67 and the passage 159 is in fluid communication with the passage 71. Each bushing 155 extends between a lug 133, 135 and its associated arm 33, 31, respectively, and has two circumferential O-rings 161 in grooves for sealing between the bushing 155 and its associated arm 33, 31 and lug 133, 135 respectively. For assembly purposes, each bushing 155 includes a pair of extending ears 163 which may be engaged by a spanner wrench for insertion of the bushing 155 or grasped for removal of the bushing 155 during service. Bushing removal may be effected by removing its associated retaining plug 147.

From the foregoing, it will be appreciated that if the retaining plugs 147 are removed and if each bushing 155 is withdrawn to disengage from its associated arm 31, 33, the neck 15 and the entire cylinder 10 may be slidably inserted into and removed from the space between the faces 151 of the lugs 133, 135. Thus, bench service of the cylinder 10 or complete cylinder replacement may be effected without disconnecting the hydraulic control lines and without disturbing the mounting plate 11 or the position of either lug 133, 135.

Figure 5:
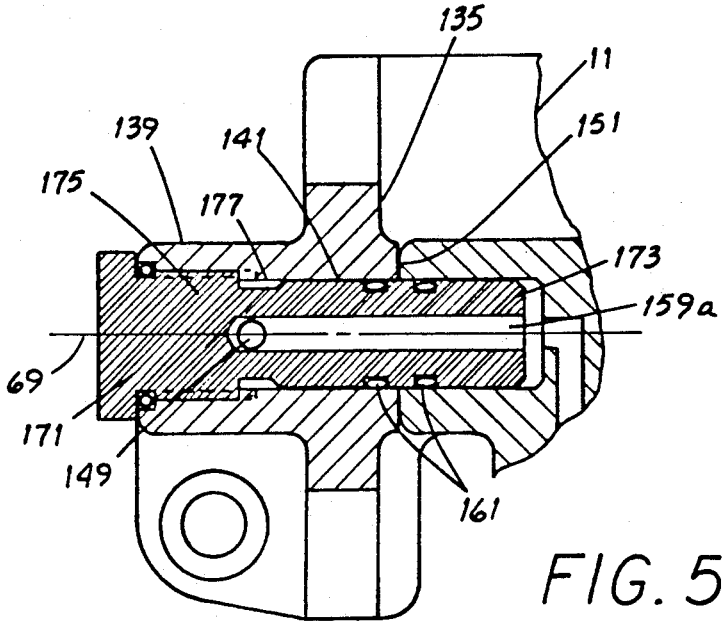
FIG. 5 is a view, partly in cross section, of another embodiment of the bushing and plug shown in FIG. 1.
Figure 7A:
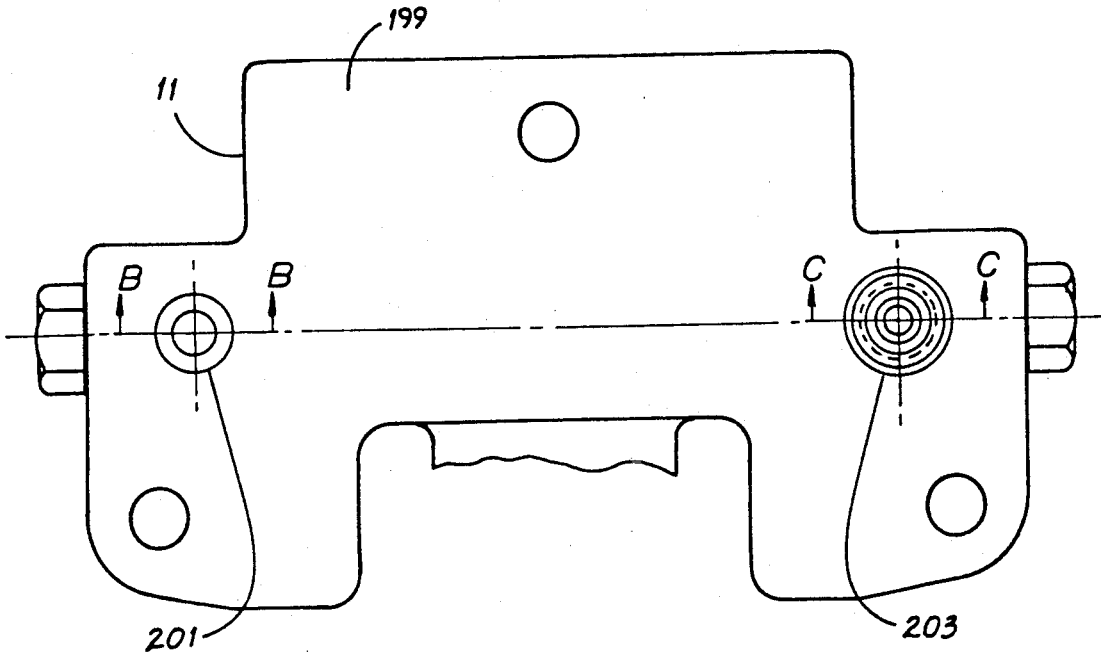
FIG. 7A is a rear elevation view of the mounting plate shown in FIG. 1
Figure 7B:
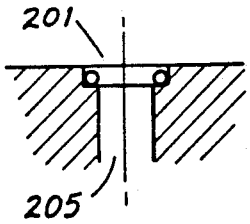
FIG. 7B is a sectional view of one type of connection port formed in the rear of the mounting plate, the view being taken along plane B—B of FIG. 7A.
Figure 7C:
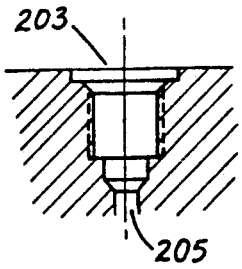
FIG. 7C is a sectional view of another type of connection port formed in the rear of the mounting plate, the view being taken along the plane C-C of FIG. 7A.

FIG. 5 shows another embodiment which combines the retaining plug 147 and its associated bushing 155 into a single composite plug 171. This plug 171 includes a bushing segment 173 and a retaining segment 175. A transverse hole 149 is formed in the plug 171 to intersect the bushing passage **159*a* and an annular relief 177 is formed between the bushing segment 173 and the retaining segment 175 at a location such that it intersects with the hole 149. In that way, fluid will be able to flow between the passage 159*a*, the hole 149, the annular relief 177 and a port which may be formed in the back of the mounting plate. Examples of such ports are shown in FIGS. 7A-7C and are described below. From the foregoing, it is to be understood that for a single cylinder 10, both sets of retaining plugs and bushings, of which plug 147 and bushing 155 are one set, can be combined to two composite plugs 171, one to connect each arm and its associated lug, e.g., arm 33 and lug 133**.

Figure 6:
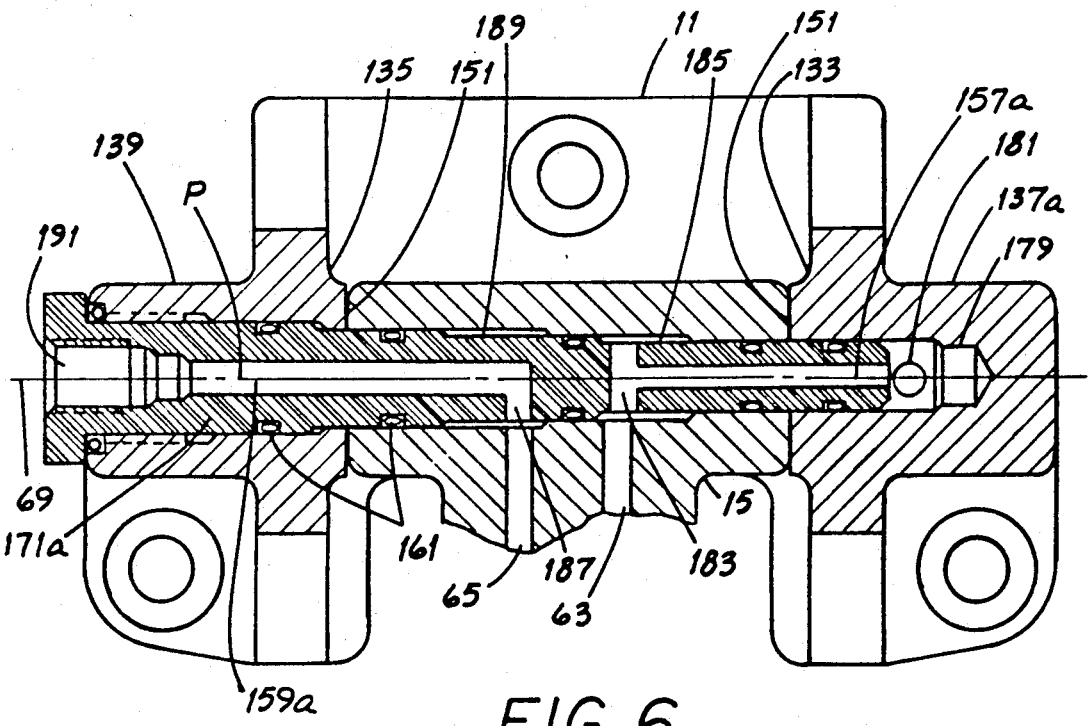
FIG. 6 is a view, partly in cross section with parts broken away, of yet another embodiment of the bushing and plug shown in FIG. 1

Another embodiment is illustrated in FIG. 6 which shows a composite plug **171*a* which is used in place of two bushings 155 and two retaining plugs 147 as shown in FIG. 1. In the illustrated embodiment, the sleeve 137*a* has a pocket 179 formed to depth a therein to receive one end of the composite plug 171*a*. A transverse hole 181 is formed in the mounting plate to intersect with the pocket 179. This hole 181 may be terminated in a port in the rear of the mounting plate 11**. Such ports may be of the type shown in FIGS. 7A-7C and described below.

The composite plug **171*a* has a longitudinal passage 157*a* which intersects with a transverse passage 183. An annular relief area 185 is formed on the composite plug 171*a* to intersect with the transverse passage 183. In that manner, fluid may flow between the first passage 63, the passage 183 and the passage 157*a*, irrespective of the rotational position at which the composite plug 171*a*** is inserted and finally seated.

The composite plug **171*a* also includes a longitudinal passage 159*a* formed to a depth to intersect with a radial transverse passage 187. Another annular relief area 189 is formed on the composite plug 171*a* to intersect with the passage 187. This arrangement permits fluid communication between the passage 159*a* and the passage 65, irrespective of the rotational position at which the plug 171*a*** is inserted and finally seated.

In the illustrated embodiment, an axial port 191 is brought to the exterior of the plug **171*a* and is arranged to be in fluid communication with the passages 159*a*, 187 and 65**. Annular O-ring seals prevent leakage of fluid between various portions of the assembly and are located and installed in a known manner.

It is to be appreciated from the foregoing that in place of the port 191, another radial transverse hole could be formed in the composite plug **171*a* at location P to permit fluid to flow between the passage 159*a* and a port formed in the rear of the mounting plate 11. Such an arrangement would be similar to that shown in FIG. 1. From the foregoing it is also to be appreciated that rather than configure the neck 15 to have pockets 195 formed to a depth in the arms 31, 33 as shown in FIG. 2, a single opening 197 is formed through the arms 31, 33 and has a generally uniform diameter and a longitudinal axis which is generally concentric with axis 69**.

One of the advantages of the arrangement described above with respect to FIG. 6 is that the composite plug **171*a* is formed as a single piece. This plug 171*a* replaces four pieces as shown in FIG. 1, i.e., two retaining plugs 147 and two bushings 155. It is therefore less likely that the servicing person will inadvertently lose one of the parts as the cylinder 10 is being removed from the mounting plate 11**.

In addition, the illustrated arrangement permits removal of the improved cylinder 10 from the mounting plate 11 even though access to the cylinder 10 and mounting plate 11 may be available from only one side. That is, the cylinder 10 can be removed by withdrawing a single composite plug **171*a* from only one side. Therefore, other boat hardware may be mounted in an abutting relationship to the right side of the mounting plate 11 as shown in FIG. 6 but the ability to perform service will not thereby be impaired. It will be apparent from the foregoing that the arrangement shown in FIG. 6 could be reversed so that the composite plug 171*a* is withdrawn from the right, rather than the left, side of the mounting plate as viewed in FIG. 6**.

It is also to be appreciated that the composite plugs 171 of FIG. 5 or the composite plug **171*a* of FIG. 6** could be retained by snap ring(s) so long as suitable fluid-tight closures are provided.

FIGS. 7A-7C illustrate how connection ports 201, 203 may be brought out at the rear side of the mounting plate 11. The surface 199 of the mounting plate 11 which is shown in FIG. 7A is that which would be adjacent the transom of the boat when the mounting plate 11 is installed. Referring particularly to FIGS. 7A and 7B, the ports could be of the common SAE O-ring flange type wherein a flanged hose end (not shown) is bolted to the surface 199 to provide fluid communication with the SAE flange port 201.

Referring particularly to FIGS. 7A and 7C, the mounting plate 11 may be configured to have a common SAE straight thread port 203. Irrespective of the type of port formed in surface 199, or even if one such port is used when the embodiment of FIG. 6 is employed, connection between the cylinder 10 and the remote hydraulic control unit (not shown) will be facilitated.

Yet another way of attaching the mounting plate 11 to the transom of a boat is by the use of a manifold block (not shown) interposed between the plate 11 and the transom. The construction and use of such blocks is well known. With such an arrangement, the hydraulic hoses are coupled to the interior side of the manifold block and the mounting plate 11 bolted to its exterior side. At the interface of the block and the mounting plate 11, the use of SAE flange ports such as port 201 is preferred. SAE straight thread ports, such as port 203, are preferred for connecting the hoses to the block.

It is also to be appreciated that the passages 205 shown in FIGS. 7B and 7C communicate with the associated passages in the bushings 155, in the composite plugs 171 or in the composite plug 171*a*, as the case may be.

In operation and referring to FIG. 1, it is assumed that the operator wishes to extend the cylinder rod 27 to push the trim tab downward. To do so, hydraulic fluid under pressure will be valved into the hydraulic hose connected to the hole 149 adjacent lug 135 and thence to the passage 159, the passage 71 and the passage 65 to the second expansible chamber 165. The piston assembly 23 will move downward as shown in FIG. 1 and the volume of the first chamber 99 will diminish. Hydraulic fluid will be urged out of the first chamber 99 and through the pocket 95 to the passage 97 and the annular space 61 to the passage 51. From there, it will flow through the passage 63, the passage 67 and into the hole back 149 to the control unit. To retract the cylinder 10, the flows will be reversed. From the foregoing, the operation of the other embodiments may be readily understood and need not be described further.

From the foregoing, those of ordinary skill in the art will appreciate that alternate construction arrangements could be made without departing from the spirit of the invention.

While the principles of this invention have been described in connection with specific embodiments, it should be understood clearly that these descriptions are made only by way of example and are not intended to limit the scope of the invention.

What is claimed is:

1. A hydraulic cylinder assembly of the type arranged for pivoting cylinder movement to position a trim tab on a boat and comprising:

a mounting plate including a front surface and a generally flat rear mounting surface having a plurality of holes formed therein for flowing fluid therethrough, such plate further having a pair of lugs integrally formed as one piece with such plate and extending outward from such front surface in a direction generally away from such rear surface, each of such lugs including a generally flat face spaced from that of the other lug;

a double-acting hydraulic cylinder having a longitudinal axis, a neck for mounting to such plate and first and second expansible chambers for alternately receiving pressurized hydraulic fluid;

a pair of bushings, each such bushing extending between and in sealing engagement with a lug and such neck, each such bushing including a passage in fluid communication with a passage in such neck and with a hole in such rear mounting surface, each such bushing being removable from such assembly without affecting the position of either lug;

a sealing plug for retaining each such bushing while yet permitting fluid flow through such bushing passage;

such neck being generally T-shaped and including a body extending along such longitudinal axis and a pair of arms extending laterally outward from such body in a direction generally normal to such axis, each such arm including a generally flat surface in contacting, non-overlapping relationship with a face of a lug; the hydraulic cylinder thereby being powered through such holes in the rear surface of such mounting plate and being removable from such plate without affecting the position of the mounting plate or either lug.

2. The assembly of claim 1 wherein such hydraulic cylinder includes an outer wall having a proximal end, wherein such neck further includes a body having regions of progressively decreasing diameter and wherein such regions extend into such proximal end thereby facilitating attachment of such walls to such body.

3. A hydraulic cylinder assembly of the type arranged for pivoting cylinder movement to position a trim tab on a boat and comprising:

a mounting plate including a front surface and a generally flat rear mounting surface having a plurality of holes formed therein for flowing fluid therethrough, such plate further having a pair of lugs integrally formed as one piece with such plate and extending outward from such front surface in a direction generally away from such rear surface, each of such lugs including a generally flat face spaced from that of the other lug;

a double-acting hydraulic cylinder having a longitudinal axis, a neck for mounting to such plate and first and second expansible chamber for alternately receiving pressurized hydraulic fluid;

a pair of composite plugs, each such plug extending between and in sealing engagement with a lug and such neck, each such plug including an annular relief and a passage in fluid communication with a passage in such neck and with a hole in such rear mounting surface, each such plug being removable from such assembly without affecting the position of a lug, each such plug being devoid of exterior ports;

such neck being generally T-shaped and including a body extending along such longitudinal axis and a pair of arms extending laterally outward from such body in a direction generally normal to such axis, each such arm including a generally flat surface in contacting, non-overlapping relationship with a face of a lug;

the hydraulic cylinder thereby being powered through holes in the rear surface of such mounting plate and being removable from such plate without affecting the position of the mounting plate or either lug.

4. The assembly of claim 3 wherein such hydraulic cylinder includes an outer wall having a proximal end, wherein such neck further includes a body having regions of progressively decreasing thereby facilitating attachment of such walls to such body.

5. A hydraulic cylinder assembly of the type arranged for pivoting cylinder movement to position a trim tab on a boat and comprising:

a mounting plate including a front surface and a generally flat rear mounting surface having a hole formed therein for flowing fluid therethrough, such plate further having a pair of lugs integrally formed as one piece with such plate and extending outward from such front surface in a direction generally away from such rear surface, each of such lugs including a generally flat face space from that of the other lug;

a double-acting hydraulic cylinder having a longitudinal axis, a neck for mounting to such plate and first and second expansible chambers for alternately receiving pressurized hydraulic fluid;

a generally cylindrical one-piece composite plug having a pivot axis and extending between and in sealing engagement with each lug and such neck, such plug including a first passage in fluid communication with a passage in such neck and with a hole in such rear mounting surface and further including a second passage in fluid communication with another passage in such neck and with a connection port generally concentric with such pivot axis for receiving an external hydraulic connection, such plug being removable from such assembly for detachment of such cylinder without affecting the position of either lug;

such neck being generally T-shaped and including a body extending along such longitudinal axis and a pair of arms extending laterally outward from such body in a direction generally normal to such axis, each such arm including a generally flat surface in contacting, non-overlapping relationship with a face of a lug; the hydraulic cylinder thereby being powered through such hole in the rear surface of such mounting plate and through such connection port and being removable from such plate without affecting the position of the mounting plate or either lug.

6. The assembly of claim 5 wherein such hydraulic cylinder includes an outer wall having a proximal end, wherein such neck further includes a body having regions of progressively decreasing diameter and wherein such regions extend into such proximal end thereby facilitating attachment of such walls to such body.

* * * * *